US011008892B2

(12) United States Patent
Brun et al.

(10) Patent No.: US 11,008,892 B2
(45) Date of Patent: May 18, 2021

(54) CONNECTION BETWEEN A CIRCULAR SHELL AND A RADIAL STRUCTURAL ARM OF A TURBOMACHINE, COMPRISING A SEAL AND ITS SUPPORT

(71) Applicant: SAFRAN AIRCRAFT ENGINES, Paris (FR)

(72) Inventors: Guillaume Matthieu Jean-Louis Brun, Chilly-Mazarin (FR); Matthieu Jean Luc Marc Loger, Orly (FR); Guillaume Perez, Combs la Ville (FR); Kenny Marcel Porte, Valpuiseaux (FR); Philippe Christophe Savignac, Wissous (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 585 days.

(21) Appl. No.: 15/901,983

(22) Filed: Feb. 22, 2018

(65) Prior Publication Data

US 2018/0238192 A1 Aug. 23, 2018

(30) Foreign Application Priority Data

Feb. 23, 2017 (FR) ..... 17 51452

(51) Int. Cl.

| | |
|---|---|
| ***F01D 25/24*** | (2006.01) |
| ***F04D 29/08*** | (2006.01) |
| ***F01D 11/00*** | (2006.01) |
| *F04D 29/54* | (2006.01) |
| *F01D 25/16* | (2006.01) |

(52) U.S. Cl.

CPC ..... *F01D 25/243* (2013.01); *F01D 11/005* (2013.01); *F04D 29/083* (2013.01); *F01D 25/162* (2013.01); *F04D 29/542* (2013.01); *F05D 2240/14* (2013.01); *F05D 2240/55* (2013.01)

(58) Field of Classification Search

CPC ..... F01D 25/243; F01D 11/005

See application file for complete search history.

(56) References Cited

U.S. PATENT DOCUMENTS 9,638,057 B2 * 5/2017 Kwon ..... F01D 25/12
9,850,774 B2 * 12/2017 Vo ..... F01D 11/005

(Continued)

FOREIGN PATENT DOCUMENTS

| | | |
|---|---|---|
| FR | 2510220 A1 | 1/1983 |
| FR | 3010154 A1 | 3/2015 |
| WO | 2014051700 A1 | 4/2014 |

OTHER PUBLICATIONS

Search Report issued in French Patent Application No. 1751452 dated Nov. 15, 2017.

*Primary Examiner* — David Hamaoui
*Assistant Examiner* — John S Hunter, Jr.
(74) *Attorney, Agent, or Firm* — Pearne & Gordon LLP

(57) ABSTRACT

A seal (13) closing off a clearance (9) between one end in the form of a bowl (7) of an arm (4) and a circular shell (1) of a turbomachine is compressed between the rim (8) of the bowl by a support (14) distinct from the platform (10) delimiting the gas flow stream (5) and retained by screws (11) already present to fix the platform to the shell (1). The layout is lighter in weight and the resistance of seal does not depend on the platform (10) exposed to damage.

7 Claims, 2 Drawing Sheets

(56) References Cited

U.S. PATENT DOCUMENTS

| | | | | |
|---|---|---|---|---|
| 2006/0175836 | A1* | 8/2006 | Williams | B64D 41/00 285/414 |
| 2015/0016947 | A1* | 1/2015 | Kwon | F01D 25/12 415/1 |
| 2015/0330245 | A1* | 11/2015 | Vo | F02C 7/28 415/173.1 |
| 2017/0241292 | A1 | 8/2017 | Perez et al. | |

* cited by examiner

CONNECTION BETWEEN A CIRCULAR SHELL AND A RADIAL STRUCTURAL ARM OF A TURBOMACHINE, COMPRISING A SEAL AND ITS SUPPORT

FIELD OF THE INVENTION

This invention relates to a connection between a circular shell and a radial structural arm of a turbomachine, comprising a seal and its support

BACKGROUND OF THE INVENTION

Turbomachine structures comprise hollow radial arms located between concentric shells, the ends of which consist of rims placed on the shells while leaving a connection clearance between them. A seal is often arranged at this connection to maintain leak tightness, particularly when the hollow arms can provide a pathway for oil leaks that could ignite; the seal would then prevent the fire from propagating outside the arms and spreading around the shell.

In some designs, the seal is formed along the clearance by deposition of a leak tight material that is allowed to set, but the structure assembly time is extended by the need to interrupt other work while waiting for this process to complete. Maintenance of the machine is also complicated if the seal has to be eliminated to separate the arm and disassemble it from the shell, and it also has to be removed again after every operation on the arm.

In document FR-3 010 154-A, the seal is held in place by a support that compresses it in contact with the rim of the arm. This support is a large lip contiguous with the rim that belongs to a platform concentric with the shell and the function of which is to cover the rim of the arms or the vane to shell junctions to restore a smooth circular surface suitable for a gas flow through the turbomachine. Assembly becomes faster, but the design has a disadvantage in that this support significantly increases the weight of the platform; however, there is an ongoing attempt to reduce weight in this technical field. And if the platform breaks, which is possible following the ingestion of solid bodies (hailstones or birds) into the turbomachine, the seal might be unable to retain it and it could escape, creating safety risks.

SUMMARY OF THE INVENTION

Therefore, an attempt was made to find a connection better than that described in the above document, one important purpose of which is to obtain a lighter weight support for the seal; the other disadvantages of previous designs mentioned above have also been removed.

The invention generally concerns a connection arrangement between a circular shell and a radial structural arm of a turbomachine, the arm comprising one end provided with a rim adjacent to the shell, the layout also including a platform concentric with the shell and fixed to the shell leaving (delimiting with the shell) an annular space containing the rim, and a seal present in the annular space and placed on the shell and forced into contact with the rim thus closing off a clearance between the rim and the shell, the layout being characterised in that it comprises a seal support that is distinct from the platform and is retained by attachment means that are also used to fixed the platform to the shell.

The seal support is distinct from the platform, and there is more freedom in manufacturing it and in particular it can be small and lightweight; it is not likely to disappear and allow the seal to be lost if the platform is damaged; and the use of existing attachment means to fix the platform to the shell avoids further complications to the layout.

In one form particularly conductive to a lightweight support, the support comprises a reinforcement with a shape similar to an external contour of the rim that forms a backing for the seal, and attachment cleats connected to the reinforcement, separated from each other and terminating at the said screws.

An even further optimised construction that is also easy to assemble, is characterised in that the attachment cleats are elastic and can extend along a dotted line, and said cleats are made in a single piece with the support that is metallic.

Finally, in the case of a failure of the platform, permanence of the assembly is confirmed if the layout comprises inserts around the attachment means, onto which the platform is click fitted, the support is compressed between the platform and the inserts, and the inserts are compressed between the support and the heads of the attachment means.

BRIEF DESCRIPTION OF THE DRAWINGS

The different aspects, characteristics and advantages of the invention will now be described in more detail with reference to the following figures, that represent one detailed embodiment that is not exclusive of others.

DETAILED DESCRIPTION OF THE INVENTION

Figure 1:
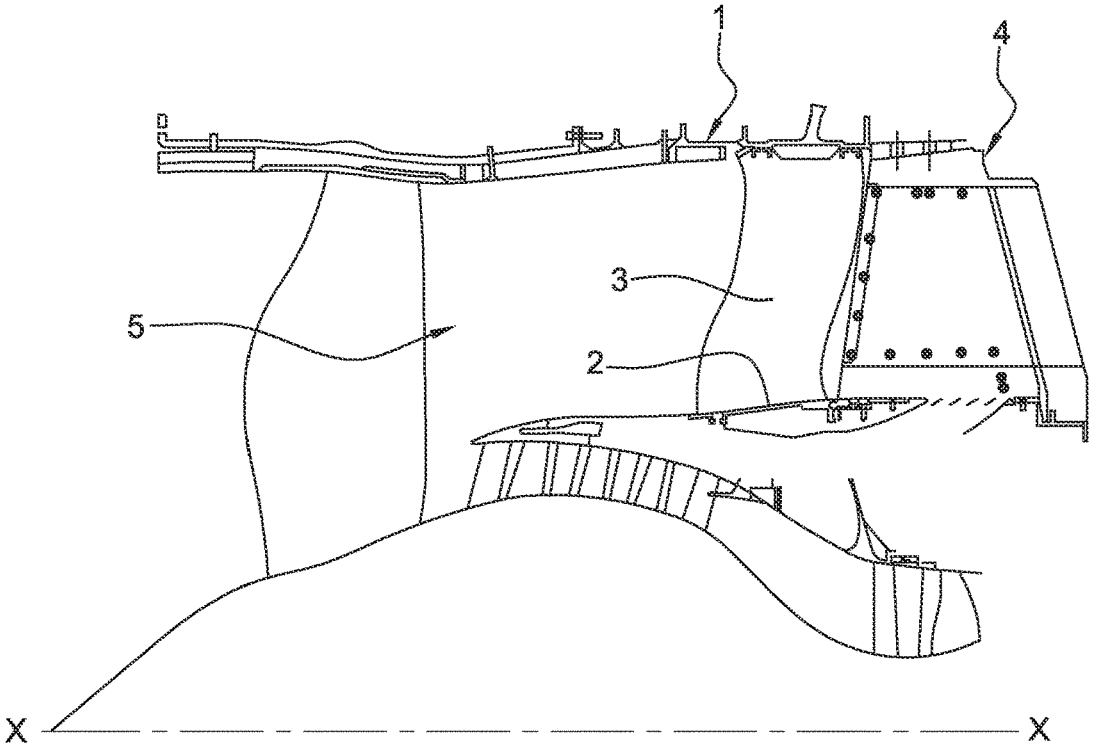
FIG. 1 is an axial sectional view showing part of a turbomachine and the possible location of the invention.

FIG. 1 shows a region of a turbomachine on which the invention can be used, between an intermediate case shell (ICS), hereinafter simply called the shell 1, that surrounds a hub 2. Fixed vanes 3 ("outlet guide vanes" or OGV) and arms 4 along the radial direction in the turbomachine connect the shell 1 to the hub 2. In this case, the fixed vanes 3 lie in a bypass flow stream 5 of a twin spool engine, although this is not compulsory for the invention.

Figure 2:
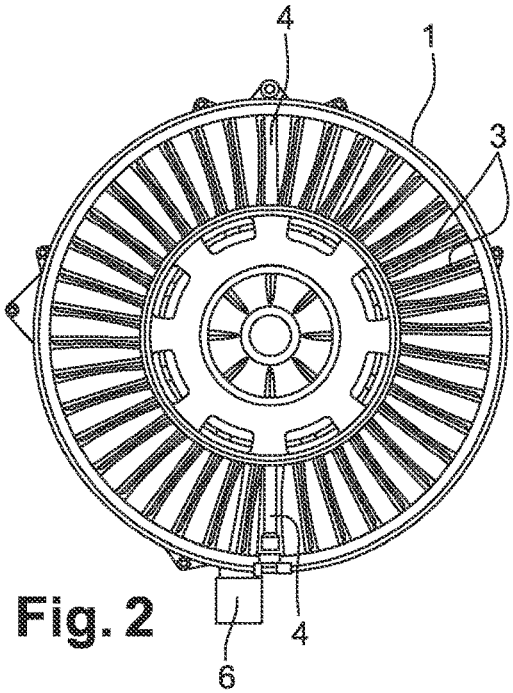
FIG. 2 is a cross-section through the turbomachine.

The embodiment described comprises two opposite arms 4, represented in FIG. 2, one of which is at the 6 o'clock angular position and terminates in front of a transfer gearbox (TGB) 6. The arm 4 is hollow and open, and a radial shaft (not shown) can pass through it to start the turbomachine by transmitting energy from an electric motor to its rotor through the gearbox 6 and other transmissions. However, oil can escape from the gearbox 6 and spread into the arm 4, with fire risks that justify confinement of the internal volume of the arm 4.

Figure 4:
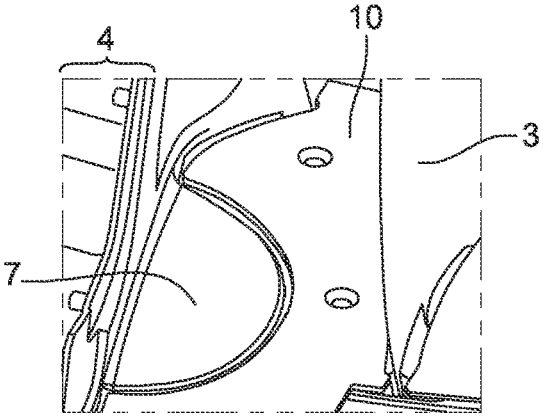
FIG. 4 is a perspective view of this layout, seen from the flowstream.
Figure 3:
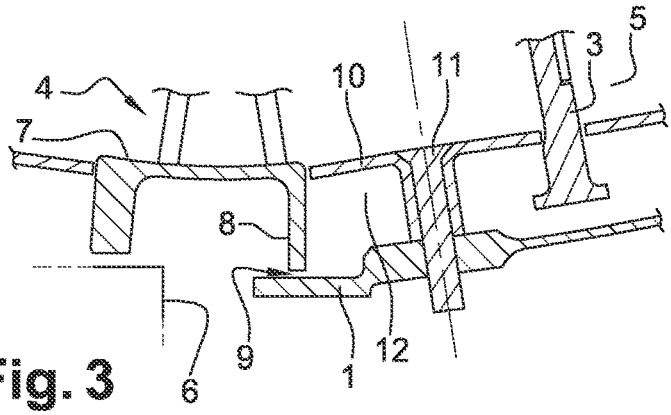
FIG. 3 is a cross-section showing the connection layout without the seal, between the arm and the shell.

The layout of the connection of the arm 4 to the shell 1 is shown on FIGS. 3 and 4. The end of the arm 4 is shaped as an enlargement called a bowl 7 and that includes a cylindrical rim 8 that extends in the direction radial to the X-X axis of the turbomachine, the end of which is separated from the shell 1 by a clearance 9 in which the seal must be maintained. A platform 10 concentric with the shell 1 is assembled to the shell by attachment means such as screws 11, delimiting with the shell an annular or essentially annular space 12 in which the bowl of each arm 4 and the ends of the fixed vanes 3 are contained, and thus to limit the flow stream 5 by a regular and continuous surface. In reality, the platform 10 is composed of distinct elements assembled individually to the shell 1 and each extending on an angular sector of the machine between two adjacent fixed vanes 3, or one of the arms 4 and one of the fixed vanes 3 adjacent to it. Only one of these elements is shown completely herein, but they are in physical contact once assembled and therefore the platform 10 is continuous. It is circular or essentially circular, its elements possibly being curved or plane.

Figure 5:
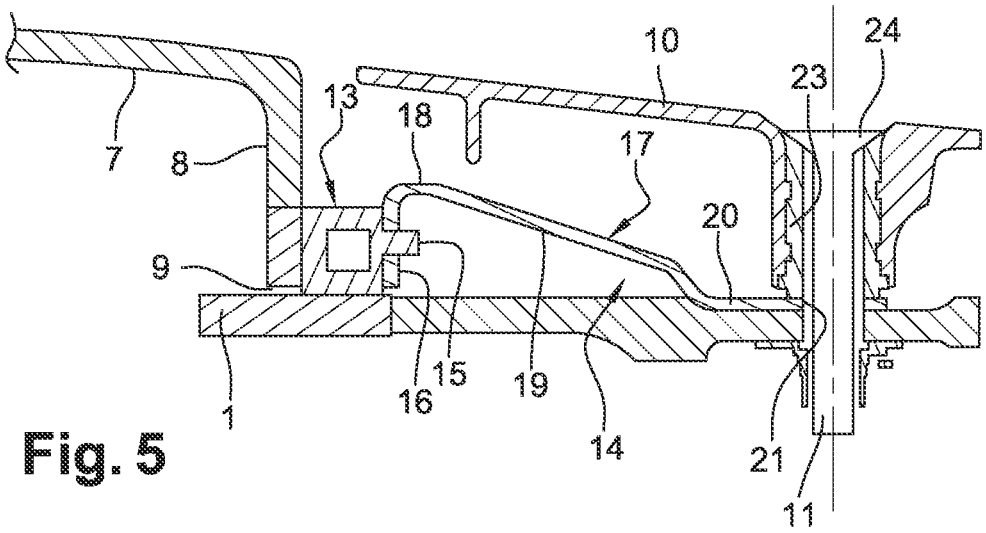
FIG. 5 is a cross-section showing the layout according to the invention.
Figure 6:
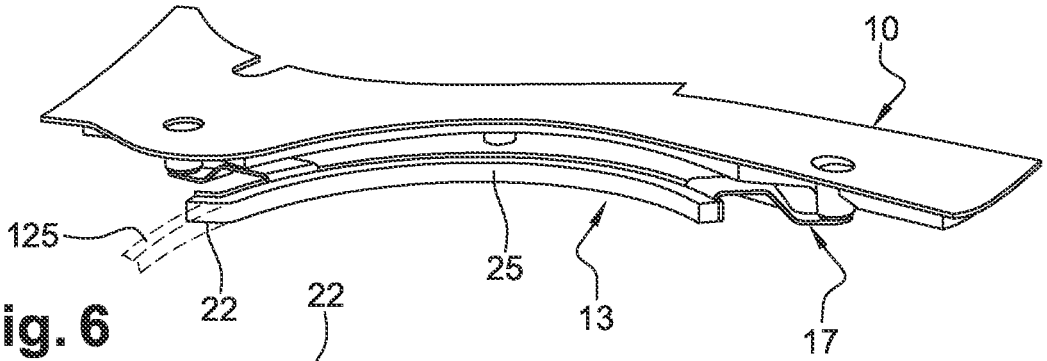
FIGS. 6 and 7 are perspectives views showing the seal and its support along two opposite directions.

The layout is completed by a seal 13 and its support 14, as shown on FIGS. 5 and 6. The seal 13 is deformable and elastic, it is placed on the shell 1 and compressed in contact with the rim 8 to close off the clearance 9. The support 14 acts as backing for its opposite face on which pins 15 are formed to retain it. The shape of the support 14 can be circular, in a single piece, and it comprises a reinforcement 16, with a shape similar to an external contour of the rim 8, and therefore in this case is a plate curved along the arc of a circle concentric with the rim 8, and attachment cleats 17 made as a single piece from the same material, starting from the external edge of the reinforcing 16 along divergent directions and extending to some of the attachment screws 11 of the platform 10. The reinforcement 16 is at a uniform distance from the rim 8 and is drilled at a constant pitch to contain the pins 15. The attachment cleats 17 are composed of successive portions forming a dotted line, namely a portion 18 connected to an inner edge (at a distance from the shell 1) of the reinforcement 16 and with no radial inclination, an intermediate portion 19 with a radial inclination and an end 20 with no radial inclination, placed on the shell 1 and provided with a drilling 21 through which the screw 11 passes. The support 14 is advantageously metallic, for example made of titanium, the attachment cleats have high elasticity and a capacity for deformation that facilitates their assembly while maintaining a well-defined compression of the seal 13 between the reinforcement 16 and the rim 8.

Figure 7:
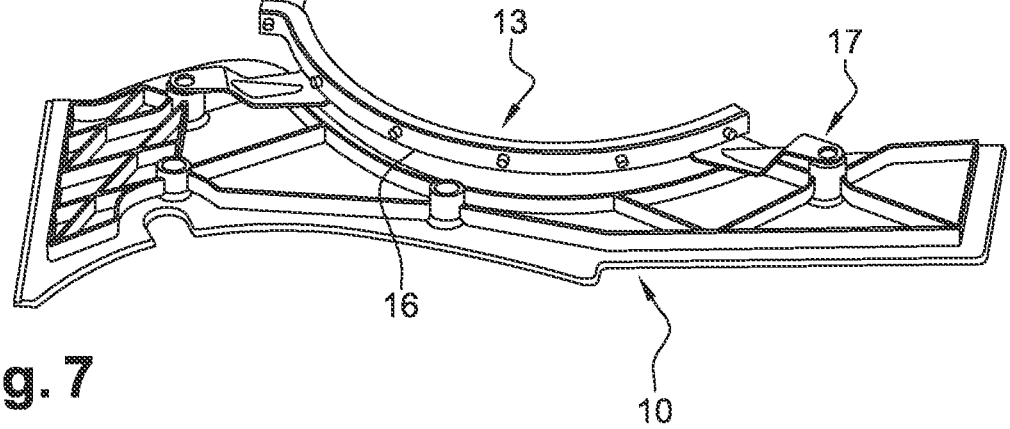

FIGS. 6 and 7 show that the seal 13 and the support 14 are usually composed of successive sectors of a circle to facilitate assembly around the rim 8. The sectors 25 of the seal 13 can be provided with overlap portions 22 curved outwards from the reinforcement 16 relative to the main part of the sector and that bear on a complementary end of an adjacent sector (25 on FIG. 6) so as to assure good continuity of the seal 13. Several attachment cleats 17 will generally be provided for better attachment of the seal 13, for example twice two if the seal 13 and the support 14 are composed of two semicircular portions, as in this case.

The platform 10 is indirectly retained by screws 11, being click fitted around metallic inserts 23 threaded around each screw 11, and that the heads 24 of screws 11 push towards the shell 1 by compressing the attachment cleats 17 around the drillings 21. This layout maintains the attachment of the support 14 and the seal 13 by screws 11 and inserts 23 even if the platform 10, exposed to damage and frequently made of a weaker material (for example polymer) than the screws 11 and inserts 23, disappears at this location.

The invention claimed is:

1. A connection layout in a turbomachine between a shell, the shell being circular in shape, and an arm extending in a radial direction of the turbomachine, the arm comprising a rim at an end, the rim being adjacent to the shell and separated from the shell by a clearance, the connection layout further comprising:

a platform concentric to the shell, with an annular space being comprised between the shell and the platform and the rim being contained in the annular space; and a seal present in the annular space and closing off the clearance;

wherein the platform is fixed to the shell by attachment means, the seal is mounted on a support extending in the annular space, and the support is fixed to the shell by said attachment means connecting the platform to the shell.

2. The connection layout according to claim 1, wherein the support is metallic, the seal is deformable, elastic, and compressed between the rim and the support, and the support comprises a plate which extends towards the rim up to a distance that is constant along the rim.

3. The connection layout according to claim 2, wherein the rim is cylindrical, the seal and the support surround the rim, and the seal and the support are made up of a plurality of adjacent circular sectors.

4. The connection layout according to claim 2, wherein the plate comprises an end portion resting on the shell, a second portion of the plate connected to the end portion making an angle with the end portion, and the support being fixed to the shell at the end portion.

5. The connection layout according to claim 4, wherein the attachment means comprise screws and inserts threaded along the screws, and the end portion of the support comprises apertures through which the screws pass, the inserts compressing the end part onto the shell and the inserts being compressed by heads of the screws, and the platform being fitted around the inserts.

6. The connection layout according to claim 1, wherein the attachment means comprise screws, and the support comprises apertures through which the screws pass.

7. The connection layout according to claim 5, wherein the inserts are metallic and the platform includes a polymer.

* * * * *